United States Patent [19]

Jolkovski

[11] 4,282,668

[45] Aug. 11, 1981

[54] MOUNTING SYSTEM AND METHOD

[75] Inventor: Robert M. Jolkovski, Arlington, Mass.

[73] Assignee: Product Planning & Development, Inc., Boston, Mass.

[21] Appl. No.: 95,997

[22] Filed: Nov. 20, 1979

[51] Int. Cl.[3] ..... G09F 1/12

[52] U.S. Cl. ..... 40/155; 40/152.1; 248/488; 248/490

[58] Field of Search ..... 40/152, 156, 155, 152.1; 248/603, 488, 490

[56] References Cited

U.S. PATENT DOCUMENTS

| | | | |
|---|---|---|---|
| 2,661,560 | 12/1953 | Malby | 40/155 |
| 2,698,470 | 1/1955 | Buedingen | 40/156 |
| 2,807,110 | 9/1957 | Buedingen | 40/156 |
| 2,885,166 | 5/1959 | Lehni et al. | 248/490 |
| 3,003,272 | 10/1961 | Kulicke | 40/155 |
| 3,981,091 | 9/1976 | Wiener | 40/156 |
| 4,103,446 | 8/1978 | Maglott | 40/155 |

*Primary Examiner*—Gene Mancene
*Assistant Examiner*—Wenceslao J. Contreras
*Attorney, Agent, or Firm*—Weingarten, Maxham & Schurgin

[57] ABSTRACT

A spring-biased easily located frame clip mounting system is disclosed for "frameless" picture mounting in which a U-shaped clip is slipped over a backing, picture and glass sandwich and is held in place by a spring attached to a plow-type anchoring device having teeth which are initially pushed through the backing at an angle, such that spring tension causes the plow teeth to dig into the backing to hold the plow anchor securely to and flat against the backing. The anchor in one embodiment is provided with an aperture and liquid adhesive is dripped through the aperture once the anchor is in place to permanently secure the anchor to the backing.

11 Claims, 6 Drawing Figures

MOUNTING SYSTEM AND METHOD

FIELD OF INVENTION

This invention relates to picture or mirror hanging systems and more particularly to "frameless" mounting systems utilizing frame clips to hold together a sandwich-like structure which includes a backing, the picture or photograph and a transparent facing sheet usually of glass or plastic.

BACKGROUND OF THE INVENTION

Various frame clips have been utilized in the past in so-called "frameless" picture mounting systems in which a picture, photograph or other piece of artwork is sandwiched between a backing, usually of cardboard or foamboard and a transparent facing sheet, either glass or plastic. The frame clip structures are used to hold the sandwich structure together and may also be used in mounting the finished article to a wall. It will be appreciated that no exterior frame need be used in order to mount pictures in this manner, from which the major benefit is derived.

While what has been described appears to be a quite simple mounting system, in practice, it is very difficult to utilize these clips because of the difficulty of maintaining alignment of all the pieces while the clips are attached. In one system, wire or cord must be simultaneously wrapped around four clip structures and securely tightened to provide requisite strength. This cannot be easily accomplished by one person due to the number of mounting elements which must be simultaneously handled. Moreover, during the tightening process, the clips often become misaligned and must be straightened before the tightening process can continue. This is time consuming and frustrating. Additionally, the amount of apparatus on the back of the picture is excessive.

Another type of frame clip is illustrated in U.S. Pat. No. 3,349,443 issued to P. Sury, Oct. 31, 1967, the so-called "Swiss clip". This clip is a unitary device having a U-shaped structure at one end and a single prong at the other end which is designed to project perpendicularly into the backing material to hold the sandwich-like structure together. This clip suffers from mechanical instability since it tends to pull out of the backing material. Moreover, the sandwich structure is not always tightly held together if the prong penetration point is not far enough inward of the edge of the sandwich structure. It will be noted that this clip is not spring loaded in a direction that would draw the clip towards the center of the picture.

A third class of frame clips are spring loaded so that each clip is drawn towards the center of the picture. These are exemplified by the clips in U.S. Pat. No. 3,003,272 issued to R. M. Kulicke on Oct. 10, 1961 and those of French Pat. No. 2,274,253 published Feb. 13, 1976; and West German Pat. No. 24-50-397 published Apr. 29, 1976. In each of these patents a frame clip is spring loaded by a spring running from the clip to an anchor secured to the backing material. In each case these anchoring devices are preattached by a rivet, screw or like device which makes positioning of the clip difficult if the prelocated anchors are not properly positioned. In order to assure proper alignment, grooves or apertures must be provided in the backing material, which is inconvenient, especially for custom size articles. In each case, either tools must be used, or special preparation of the backing is necessary, which lacks convenience.

In contrast to the above-mentioned mounting system, the subject system utilizes a spring loaded frame clip and specialized anchor to which one end of the spring is attached. The anchor includes angled teeth or prongs which depend downwardly from a base plate or like member. The teeth are angled so that they point in the direction of the clip and are sharp enough to puncture or pierce the backing material, which may be cardboard or a combination material such as foamboard. Foamboard is a backing material which has polystrene foam sandwiched between two outer sheets, usually kraft paper, in which both the outer sheets and foam are pierceable. The frame clip is generally U-shaped and adapted to slip over the backing-picture-glass sandwich. One end of a coil spring is attached at the inner edge of the clip, with the other end being attached to the anchor.

The teeth depending from the anchor act as a "plow" when the clip and anchor are in place and spring tension is applied, so as to keep the anchor securely fastened to the backing material.

To attach, the clip is hooked over the edge of the glass, backing, and picture sandwich. The plow anchor is pulled away from the clip by means of the handle and spacer which tensions the spring. The plow anchor is then pressed down into the backing material, such that the teeth pierce the backing material. The anchor is then released and the spring force pulls the plow anchor forward. Because of the angling of the teeth, the base plate of the anchor is forced downward into close contact with backing material. Once in place, the base plate is maintained flat against the backing material.

This provides for ease in the positioning and securing of the clips, because the clip may be positioned first and then the anchor pulled back and pushed in. Thus, no prelocated anchor need be used, and this system is thus universal in the sense that it is usable with a large variety of different size custom units.

In one embodiment, the anchor may subsequently be adhesively attached to the backing material by providing one or more apertures in the anchor base plate. After mounting the anchor as described, a drop of liquid adhesive may be dispensed into the aperture. If the adhesive is thin enough, it will wick out between the base plate and the backing material where it will set up. The plow type arrangement provides for "self-jigging" to hold the plate flat against the backing material for optimum positioning for a thin adhesive line which is known to provide the strongest bond. The adhesive wick-through process may also be used to secure the clip itself, if desired.

For rapid and exceptionally strong bonds, cyanoacrylate adhesive may be used, with or without an activator. This adhesive provides an exceptionally rapid and strong bond, especially in the cases of metal to paper bonds, and plastic to paper bonds where the paper is coated. Activators may be necessary for uncoated papers and cardboards or chip boards to speed glue setting.

It is therefore an object of this invention to provide an exceptionally rapid, easy mounting system for pictures and the like.

It is another object of this invention to provide spring loaded frame clips with rapidly attachable and adjustable anchoring means.

It is a further object of this invention to provide a unique anchor utilizing the plow concept for anchoring spring loaded frame clips.

It is another object of this invention to provide a self-jigging adhesively held anchor for frame clips.

It is yet another object of this invention to utilize liquid adhesives in frame clip mounting.

It is a still further object of this invention to provide an easily usable picture framing method and apparatus.

These and other objects will be better understood in connection with the following description taken in conjunction with the drawings in which:

DETAILED DESCRIPTION

Figure 1:
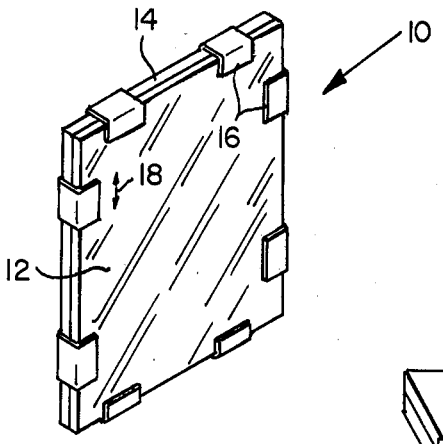
FIG. 1 is a front view of a frameless picture illustrating the positioning of frame clips in accordance with the subject invention.

Referring now to FIG. 1, a frameless picture mounting assembly 10 is illustrated as having a sandwich structure including a transparent plate 12 such as glass or plastic secured to a backing 14 by frame clips 16. The arrangement of clips must not only be sufficient for structural support but must also be pleasing in appearance, since the clips are visible and form part of the "frameless" look. Proper symmetry, if desired, is obtained by moving the clips about as indicated by arrow 18 until the requisite appearance is achieved.

As mentioned, this is not easily achieved unless the clip mounting process is made simple and convenient.

Figure 2:
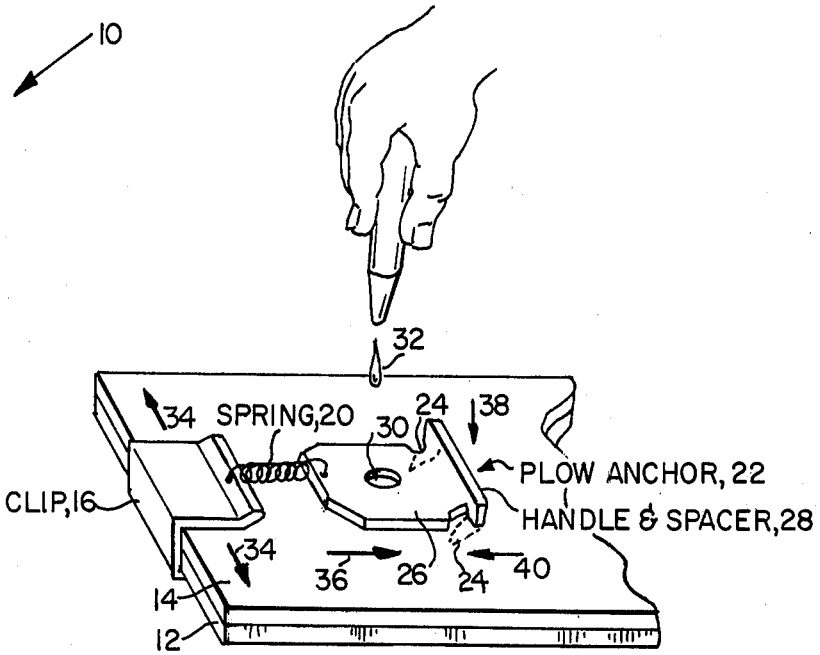
FIG. 2 is a diagrammatic illustration of the mounting of the frame clip-spring-plow anchor combination of the subject invention.

In the subject system, as illustrated in FIG. 2, clip 16 is easily mounted through the use of a spring 20 and a plow anchor 22. The anchor includes angled teeth 24 of the like which depend and may be stamped out of a base plate 26. In one embodiment, the base plate may be provided with a handle and spacer member 28 which projects away from the plane of the base plate to serve not only as a handle for pulling back the anchor, but also to keep the sandwich structure away from and parallel to any wall on which the finished structure is to be hung.

In one embodiment, base plate 26 may be provided with an aperture 30 through which a thin liquid adhesive in the form of a drop 32 may be deposited.

In operation, clip 16 is hooked over the sandwiched structure and adjusted laterally as indicated by arrows 34. Upon proper positioning, anchor 22 is moved in the direction of arrow 36 to put tension on spring 20. Teeth 24 are then passed through the pierceable backing as shown by arrow 38 and the anchor is released. Upon release the anchor moves in the direction of arrow 40 and the teeth dig into the backing material in much the same way as a plow. This secures the anchor to and presses it against the backing material.

Figure 3:
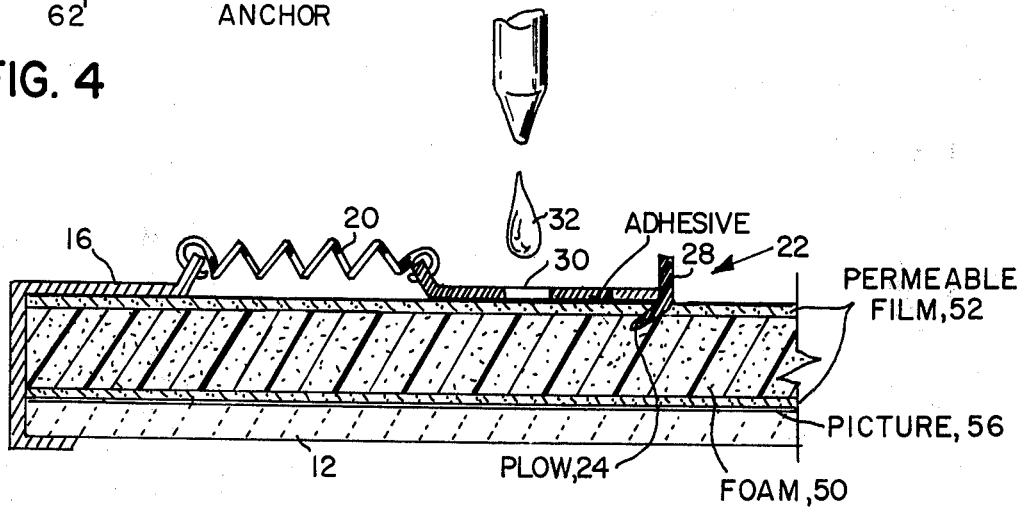
FIG. 3 is a sectional and diagrammatic illustration of the subject frame clip mounting system illustrating in cross-section the plow anchor and adhesive mounting.

It will be appreciated that the backing material must be both pierceable and thick enough so that the teeth do not penetrate through to the picture, mirror back or other hung article. Cardboard may be used or foamboard. Referring to FIG. 3, a foam central member 50 is sandwiched between two sheets of permeable films 52, such as paper, with the sandwich providing what is commonly referred to as "foamboard".

Here plow 54 is shown piercing the top film and coming to rest in the central foam member. In this figure, it is clear that a picture 56 is sandwiched between transparent member 12 and the foam core backing material.

Foamboard is excellent backing material for this application because of its light weight, pleasing appearance, and strength.

As to the liquid adhesive used, the rapidity of the set and strength would indicate the use of cyanoacrylates, although slower setting adhesives may be used because the teeth keep the anchor in place flat against the backing material without further fixturing.

Figure 4:
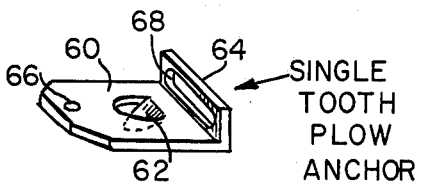
FIG. 4 is a diagrammatic illustration of a single tooth plow anchor.

Referring to FIG. 4, it will be seen that the plow anchor may take on any of a variety of forms including the single tooth embodiment illustrated. Here a base plate 60 is provided with a punched out angled tooth 62. The plate is bent so as to provide a handle/spacer 64 and is also provided with an aperture 66 for attaching a spring. Handle/spacer 64 may also be provided with a slot 68 for hanging purposes.

The punched out portion of plate 60 also provides an aperture through which glue may be dripped.

Figure 5A:
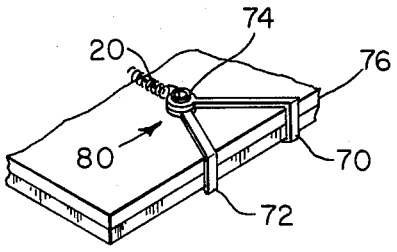
FIGS. 5A and 5B are alternative embodiments of a frame clip showing a hinged structure.
Figure 5B:
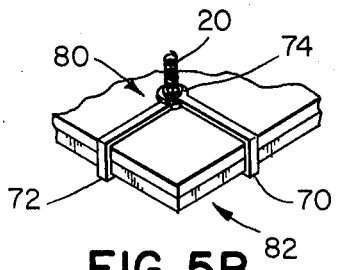

In a variation of the frame clip described, the clip may take on the bifurcated version illustrated in version of FIGS. 5A and 5B. In this version, two arms 70 and 72 are hinged or pivoted at a point 74 with a pivot point being attached to one end of the aforementioned spring 20.

The arms are themselves in the shape of clips which extend over the edges 76 of sandwich structure 80. As shown in FIG. 5A, the two arms may be pivoted in close proximity one to the other, whereas, in FIG. 5B arms 72 and 74 may be made to straddle a corner 72 of sandwich structure 80. In this manner, the bifurcated version may be utilized as a corner mount or a side mount device.

In summary, what has been provided is an easy mount frame clip device which may be conceived of as being comprised of an interconnected clip, extension spring, and plow anchor providing "take-up" force for one another. The strength of both the clip and plow is proportional to the extension of the spring and therefore to each other. Strength may be measured and calibrated by measuring the extension of the spring or by providing a premeasured projection from either the clip or the plow anchor to show appropriate or ideal spring loading. For instance, a ½ inch extension may be appropriate for a five pound picture, whereas a 1 inch extension may be appropriate for a ten pound picture.

It should be noted that the spring force tends to pull the clip tight which improves both appearance and strength of the fastener. As such, what has been provided may also be thought of as a "sandwich fastener".

It will be appreciated that the subject system will work equally well with artwork or mirrors dry mounted onto a thick, pierceable backing, whether or not glass or plastic facings are used. In this case, the clips may be used to support picture wires or the like.

It will be further appreciated that the frame clip is reusable in the same location or elsewhere unless adhesive is used. If adhesive is used, the picture may be removed and replaced by detaching the clip portion.

Note also that the frame clip is easily applied by hand and requires no tools. Further, the frame clip is self-adhesive since the spring pulls the clip into perfect alignment, and the clip pulls the plow anchor into the backing material.

Obviously, numerous changes in construction and rearrangements of the parts might be restored without departing from the scope of the invention as defined in the claims.

I claim:

1. A self-tightening frame clip mounting system comprising:

a U-shaped frame clip adapted to be slipped over a sandwich-like structure including an unprepared pierceable backing material;

a plow-type anchor assembly including a base having a front portion and teeth protruding from said base and angled downwardly towards said front portion; and, spring biasing means connected between said front portion and said frame clip so as to cause self-tightening without clip dislocation when the teeth of said plow-type anchor are pressed into said backing material.

2. The system of claim 1 wherein said base has an aperture adapted to receive adhesive therethrough.

3. The system of claim 2 and further including liquid adhesive dripped through said aperture and wicking out underneath said base after said anchor is in place.

4. The system of claim 1 wherein said U-shaped clip includes bifurcated hinged arms.

5. In combination, a structure to be hung including an unprepared pierceable backing member;

a plurality of U-shaped members adapted to surround an edge portion of said backing member;

a plow-type anchor assembly including a base having a front portion and at least one tooth angled downwardly from said base towards said front portion; and, spring biasing means connected between said front portion and said frame clip so as to cause self-tightening without dislocation of a U-shaped member when the tooth of a corresponding plow-type anchor assembly is pressed into said backing member.

6. Apparatus for mounting artwork or the like which is provided with unprepared backing material comprising:

a plurality of self-tightening U-shaped frame clips, and means for adhesively securing said frame clips to said backing material once self-tightened.

7. The apparatus of claim 6 wherein said adhesive securing means includes a base member having an aperture therethrough adapted to receive liquid adhesive.

8. The apparatus of claim 7 wherein said adhesive securing means includes adhesive between said base and said backing material.

9. A method of artwork mounting comprising:

positioning a number of U-shaped frame clips about the edges of an article to be mounted, the article having been provided with an unprepared pierceable backing material, the clips having spring loading means between clip and a plow anchor having downwardly angled teeth, pulling the anchor away from the clip towards the center of the article to be mounted, p1 pressing the teeth of the anchor into the pierceable backing material provided, and, releasing the anchor.

10. The method of claim 9 and further including adhesively attaching the anchor to the backing material once the anchor is in place.

11. The method of claim 10 wherein the adhesive attaching step includes providing the anchor with an aperture and dripping liquid adhesive through the aperture once the anchor is in place.

* * * * *